US009536498B2

(12) United States Patent
Wu et al.

(10) Patent No.: US 9,536,498 B2
(45) Date of Patent: Jan. 3, 2017

(54) APPARATUS AND METHOD FOR IMPROVING DISPLAY DEVICE AND UNEVEN DISPLAY BRIGHTNESS

(71) Applicants: BOE TECHNOLOGY GROUP CO., LTD., Beijing (CN); BEIJING BOE DISPLAY TECHNOLOGY CO., LTD., Beijing (CN)

(72) Inventors: Xingji Wu, Beijing (CN); Yu Xie, Beijing (CN); Yizhen Xu, Beijing (CN)

(73) Assignees: BOE TECHNOLOGY GROUP CO., LTD. (CN); BEIJING BOE DISPLAY TECHNOLOGY CO., LTD. (CN)

( * ) Notice: Subject to any disclaimer, the term of this patent is extended or adjusted under 35 U.S.C. 154(b) by 42 days.

(21) Appl. No.: 14/405,374

(22) PCT Filed: Apr. 25, 2014

(86) PCT No.: PCT/CN2014/076272

§ 371 (c)(1),
(2) Date: Dec. 3, 2014

(87) PCT Pub. No.: WO2015/043178

PCT Pub. Date: Apr. 2, 2015

(65) Prior Publication Data

US 2015/0287385 A1 Oct. 8, 2015

(30) Foreign Application Priority Data

Sep. 29, 2013 (CN) ..... 2013 1 0456028

(51) Int. Cl.
*G09G 5/10* (2006.01)
*G09G 5/00* (2006.01)
(Continued)

(52) U.S. Cl.
CPC *G09G 5/10* (2013.01); *G09G 3/20* (2013.01); *G09G 3/2011* (2013.01);
(Continued)

(58) Field of Classification Search
CPC .... G09G 5/10; G09G 2320/0233; G09G 3/20; G09G 2360/145; G09G 3/3648; G09G 2370/08; G09G 3/2011; G09G 2320/0223; G09G 2320/0285
See application file for complete search history.

(56) References Cited

U.S. PATENT DOCUMENTS

2009/0278866 A1* 11/2009 Kim ..... G09G 3/20 345/690
2011/0012943 A1* 1/2011 Tsai ..... G09G 3/3426 345/690
2014/0055505 A1* 2/2014 Ikeda ..... G09G 3/22 345/690

FOREIGN PATENT DOCUMENTS

CN 1617213 5/2005
CN 1892784 1/2007
(Continued)

OTHER PUBLICATIONS

Office Action in Chinese Patent Application No. 201310456028.1, dated Sep. 1, 2015.
(Continued)

*Primary Examiner* — Amit Chatly
(74) *Attorney, Agent, or Firm* — BakerHostetler LLP

(57) ABSTRACT

The present invention relates to the field of display technology, and in particular to an apparatus and a method for improving uneven display brightness, and a display device. The apparatus for improving uneven display rightness includes: a division module configured to divide a display region into a plurality of segmented regions in a scanning line direction; a collection module configured to collect
(Continued)

display brightness of the respective segmented regions; a comparison module configured to set reference brightness in a current grayscale according to the collected display brightness of the respective segmented regions; and an adjustment module configured to adjust the display brightness in the current grayscale of each segmented region according to the reference brightness in the current grayscale and the display brightness of each segmented region, so as to reduce the differences in the display brightness in the current grayscale among the respective segmented regions.

18 Claims, 5 Drawing Sheets

(51) Int. Cl.
*G09G 3/20* (2006.01)
*G09G 3/36* (2006.01)

(52) U.S. Cl.
CPC ... *G09G 3/3648* (2013.01); *G09G 2320/0223* (2013.01); *G09G 2320/0233* (2013.01); *G09G 2320/0285* (2013.01); *G09G 2360/145* (2013.01); *G09G 2370/08* (2013.01)

(56) References Cited

FOREIGN PATENT DOCUMENTS

| | | | |
|---|---|---|---|
| CN | 1991967 | | 7/2007 |
| CN | 101089941 | | 12/2007 |
| CN | 101572058 | | 11/2009 |
| CN | 101739951 | | 6/2010 |
| CN | 101996586 | A | 3/2011 |
| CN | 102314841 | | 1/2012 |
| CN | 102622990 | | 8/2012 |
| CN | 103310752 | | 9/2013 |
| JP | 2000-298450 | A | 10/2000 |
| JP | 2004184785 | | 7/2004 |

OTHER PUBLICATIONS

International Search Report and Written Opinion in PCT International Application No. PCT/CN2014/076272, dated Aug. 5, 2014.
Office Action issued in corresponding Chinese Application No. 2013104560281 dated Feb. 28, 2015.
International Search Report and Written Opinion issued in International Application No. PCT/CN2014/076272 dated Sep. 29, 2013.

* cited by examiner

APPARATUS AND METHOD FOR IMPROVING DISPLAY DEVICE AND UNEVEN DISPLAY BRIGHTNESS

CROSS-REFERENCE TO RELATED APPLICATION

The present invention claims a priority of the Chinese patent application No.201310456028.1 filed on Sep. 29, 2013 and enters the national phase of U.S. on the basis of PCT/CN2014/076272 filed on Apr. 25, 2014, which are incorporated herein by reference in their entireties.

FIELD OF THE INVENTION

The present invention relates to the field of display technology, in particular to an apparatus and a method for improving uneven display brightness, and a display device with the apparatus for improving uneven display brightness.

DESCRIPTION OF THE PRIOR ART

For an existing display device, there usually exist such drawbacks as color/temperature shift and gamma shift due to technique levels. In order to overcome these drawbacks, a gamma correction (GC) technology is generally used in the industry, i.e., a compensation voltage for correcting grayscale display of the display device is generated by a gamma correction circuit, so as to improve a display effect of the display device.

However, in the existing display device, there usually exists a phenomenon of uneven display brightness. Taking a liquid crystal display panel as an example, the liquid crystal display panel includes a first substrate and a second substrate arranged opposite to each other, the first substrate is usually an array substrate provided with pixel units, while the second substrate is usually a color film substrate provided with a color blocking layer. As shown in FIG. 1, which is a schematic view showing the connection relationship between the array substrate and a source driver in the prior art, the array substrate includes a substrate (not shown) and scanning lines 1 and data lines 2 arranged on the substrate in a crisscrossed manner. A plurality of pixel units 3 are defined by the scanning lines 1 and data lines 2. The pixel units 3 in each column are connected to each of the data lines 2, and each data line 2 is connected to the source driver 5 via a connecting wire 4, and the source driver 5 is configured to write data signals into the pixel units 3 via the data lines 2.

As shown in FIG. 1, the connecting wires 4 for connecting the data lines 2 and the source drivers 5 form a fan-out region, and the distances between different data lines 2 and the source drivers 5 are different from each other, which causes the connecting wires 4 are of different lengths, especially the outmost connecting wire 4 (a left side in FIG. 1) is far longer than the inmost one (a right side in FIG. 1). Moreover, in order to reduce the production cost, the number of the source drivers 5 is usually reduced in the prior art. In this way, more data lines 2 are required to be connected to one source driver 5, which results in greater difference in the lengths of the connecting wires 4. Since an impedance of the connecting wire 4 is in proportion to its length, so there will be a great difference in the impedances of the connecting wires 4 in the fan-out region, resulting in a great difference in voltage differences of data signals applied onto different data lines 2. Due to the great difference in voltages of the data signals in a transverse direction (a scanning line direction) within a display region, there will be a difference in the transverse display brightness, i.e., the display brightness will be uneven. As a result, the display effect of the display device will be significantly affected, and it is adverse to the user experience.

Various voltage compensation technologies in the prior art are based on the entire display region of the display device, and meanwhile an identical compensation voltage is used to the entire display region for the adjustment. As a result, it is impossible to improve the uneven display brightness at all.

SUMMARY OF THE INVENTION

An object of the present invention is provide an apparatus and a method for improving uneven display brightness of a display device, and a display device using the apparatus for improving uneven display brightness.

In one aspect, the present invention provides an apparatus for improving uneven display brightness, including:

a division module configured to divide a display region into a plurality of segmented regions in a scanning line direction;

a collection module configured to collect display brightness of the respective segmented regions;

a comparison module configured to set reference brightness in a current grayscale according to the collected display brightness of the respective segmented regions; and an adjustment module configured to adjust the display brightness of each segmented region in the current grayscale respectively according to the reference brightness in the current grayscale and the display brightness of each segmented region.

Preferably, the display region is provided with a plurality of pixel units arranged in a matrix form, the division module transversely divides the pixel units in every m columns are into one segmented region, and m is an integer greater than 0.

Preferably, the pixel units in each column are connected to a data line which is connected to a source driver, and the source driver is configured to output one data signal to the data lines according to n clock signals output from a timing sequence controller.

The division module includes a counting unit and a division unit connected to the counting unit.

The division unit divides the pixel units in the column corresponding to m×n clock signals into one segmented region every time the m×n clock signals are acquired by the counting unit.

Preferably, the counting unit includes a counter circuit configured to collect the clock signal output from the timing sequence controller to the source driver and use the clock signal as a counting pulse signal, so as to count the pixel units.

Preferably, the division unit is integrated into the timing sequence controller.

Preferably, the collection module collects the display brightness at a center of the respective segmented region as the display brightness of the segmented region, or collects the display brightness at a plurality of points within the respective segmented region and calculates an average value of the display brightness at the plurality of points as the display brightness of the segmented region.

Preferably, the comparison module compares the display brightness of the respective segmented regions and uses the minimum display brightness thereamong as the reference brightness in the current grayscale.

Preferably, the adjustment module includes a determination unit and an adjustment unit connected to the determination unit.

With respect to each segmented region, when the determination unit determines that a difference between the display brightness of the segmented region and the reference brightness is greater than a predetermined value, the adjustment unit adjusts the display brightness of the segmented region in the current grayscale according to the difference.

Preferably, the adjustment unit is integrated into the timing sequence controller.

In another aspect, the present invention provides a display device with any of the above-mentioned apparatuses for improving uneven display brightness.

In yet another aspect, the present invention provides a method for improving uneven display brightness, including:

Step S1. Dividing a display region into a plurality of segmented regions in a scanning line direction;

Step S2. Displaying an identical, initial grayscale at all the segmented regions;

Step S3. Collecting display brightness of the respective segmented regions;

Step S4. Setting reference brightness according to the collected display brightness of the respective segmented regions;

Step S5. Adjusting the display brightness in the current grayscale of each segmented region respectively according to the reference brightness and the display brightness of each segmented region, so as to reduce the differences in the display brightness in the current grayscale among the respective segmented regions; and Step S6. Displaying a next grayscale at all the segmented regions, and proceeding to Step S3.

Preferably, the initial grayscale is a grayscale of 255, and the next grayscale is a grayscale obtained by reducing the current grayscale by one grayscale.

Preferably, the display region is provided with pixel units arranged in a matrix form, the pixel units in every m columns are transversely divided into one segmented region, and m is an integer greater than 0.

Preferably, the pixel units in each column are connected to a data line which is connected to a source driver, and the source driver is configured to output one data signal to the data line according to n clock signals output from a timing sequence controller.

The pixel units in the column corresponding to m×n clock signals are divided into one segmented region every time the m×n clock signals are acquired.

Preferably, Step S3 further includes:

collecting the display brightness at a center of the respective segmented regions as the display brightness of the segmented region, or collecting the display brightness at a plurality of points within the respective segmented region and calculating an average value of the display brightness at the plurality of points as the display brightness of the segmented region.

Preferably, Step S4 further includes:

comparing the display brightness of the respective segmented regions and using the minimum display brightness as the reference brightness in the current grayscale.

Preferably, Step S5 further includes:

with respect to each segmented region, determining whether or not a difference between the display brightness of the segmented region and the reference brightness is greater than a predetermined value, if yes, adjusting the display brightness in the current grayscale of the segmented region, and if not, proceeding to Step S6.

According to the apparatus and method for improving uneven display brightness and the display device of the present invention, the display region is divided into a plurality of segmented regions in the scanning line direction by the counter circuit, and with respect to different segmented regions, different compensation voltages are applied respectively, so as to adjust the display brightness of the segmented regions and reduce the differences in the voltages of the data signals in the scanning line direction, thereby to effectively improve the uneven display brightness and the display effect of the display device as well as the user experience.

BRIEF DESCRIPTION OF TILE DRAWINGS

DETAILED DESCRIPTION OF THE PREFERRED EMBODIMENTS

The present invention will be described hereinafter in conjunction with the drawings and the embodiments. The following embodiments are for illustrative purposes only, but shall not be used to limit the scope of the present invention.

First Embodiment

Figure 1:
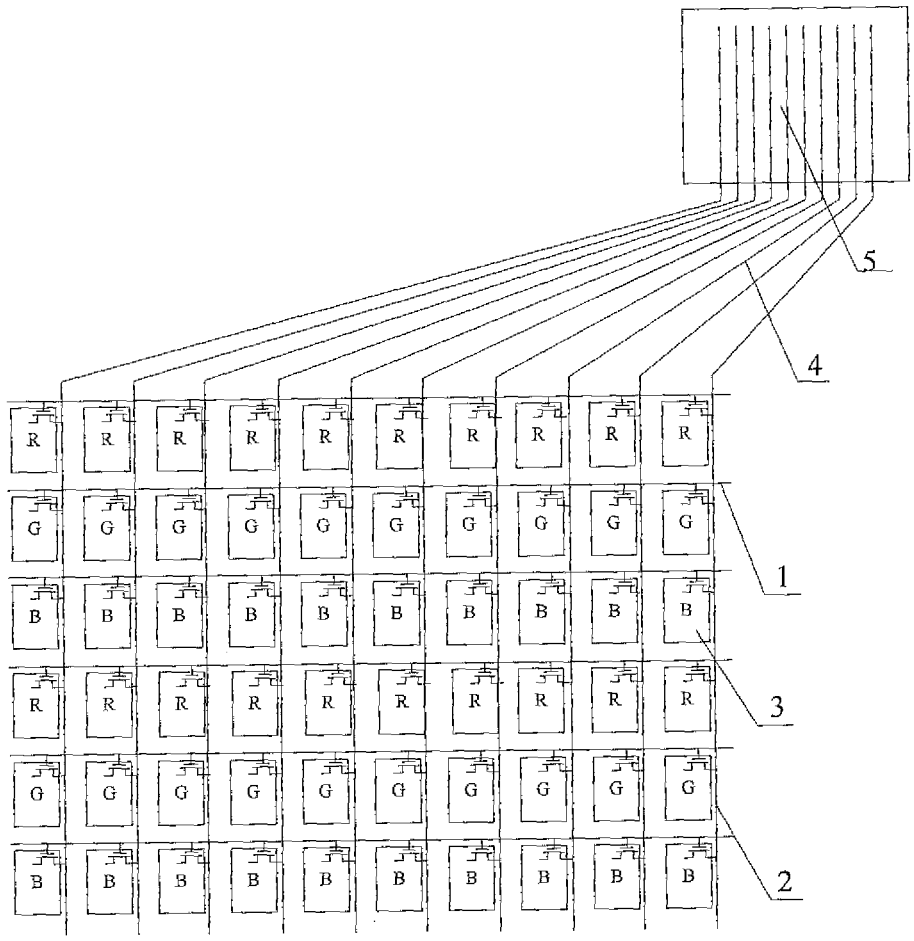
Fig.1 Prior Art
FIG. 1 is a schematic view showing the connection relationship between an array substrate and a source driver in the prior art.
Figure 2:
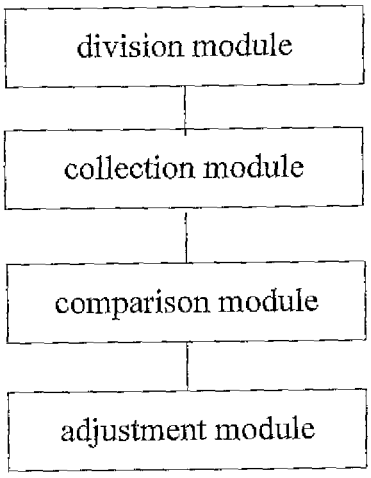
FIG. 2 is a schematic view showing an apparatus for improving uneven display brightness according to the first embodiment of the present invention.

As shown in FIG. 2, a device for improving uneven display brightness is provided in this embodiment, the device mainly includes a division module, a collection module, a comparison module and an adjustment module.

The division module is configured to divide a display region into a plurality of segmented regions in a scanning line direction.

The collection module is configured to collect display brightness of the respective segmented regions.

The comparison module is configured to set reference brightness in a current grayscale according to the collected display brightness of the respective segmented regions.

The adjustment module is configured to compensate a data signal voltage of each segmented region with a different compensation voltage respectively, i.e., to adjust the display brightness in the current grayscale of each segmented region respectively according to the reference brightness in the current grayscale and the display brightness of each segmented region, so as to reduce the differences in the display brightness in the current grayscale among the respective segmented regions.

Figure 3:
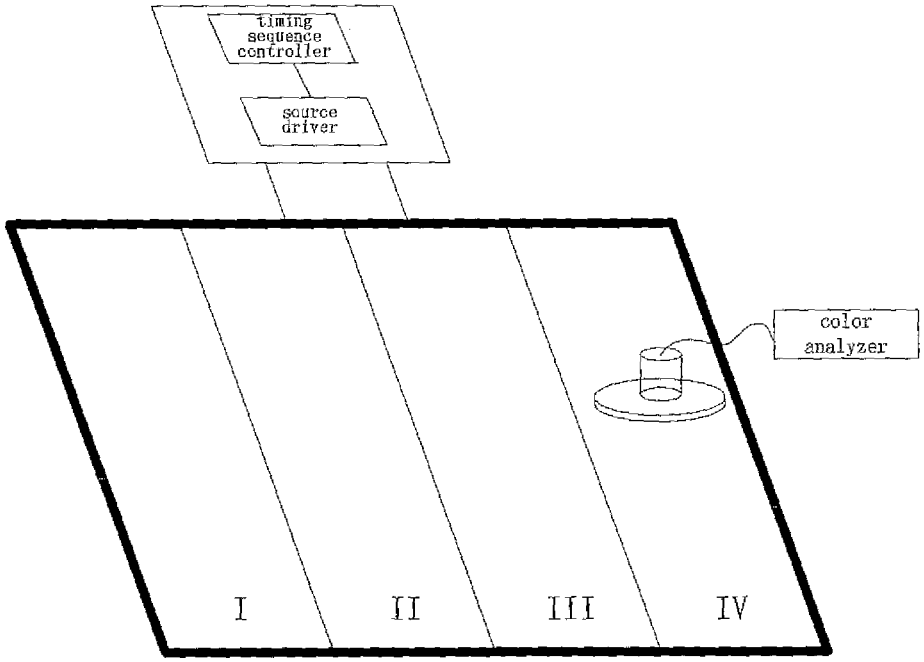
FIG. 3 is a schematic view showing a display device.

The apparatus for improving uneven display brightness of the present embodiment will be described hereinafter in details in conjunction with a display device as shown in FIG. 3.

The display device as shown in FIG. 3 mainly includes such components as a display panel and a driving means for the display panel. The driving means for the display panel includes a timing sequence controller, a source driver, and a gate driver (not shown). The display panel includes pixel units arranged in a matrix form, and the pixel units in each column are connected to a column of data lines as well as a row of scanning lines. Each data line is connected to the source driver via a corresponding connecting wire, the source driver is connected to the timing sequence controller, and each scanning line is connected to the gate driver via a corresponding connecting wire.

Figure 4:
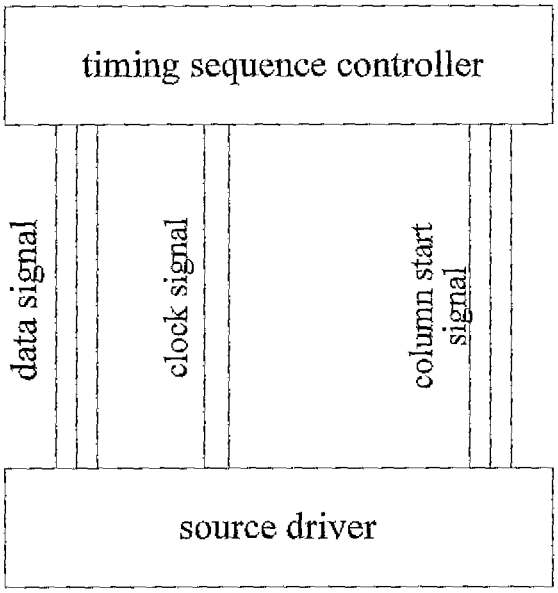
Fig.4 Prior Art
FIG. 4 is a schematic view showing a driving system for a display panel in the prior art.

As shown in FIG. 4, the timing sequence controller transmits signals such as a data signal (DATA), a column start signal (STV) and a clock signal (CP), etc. to the source driver, and transmits signals such as a row start signal (STH), a row latch signal (TP) and an output enable signal (OE), etc. to the gate driver. The source driver outputs one data signal to the data line according to n clock signals output from the timing sequence controller, so that the display panel can display an image.

Referring to FIG. 3 again, at first, the division module divides the display region of the display panel into a plurality of segmented regions in the scanning line direction. In this embodiment, since the scanning line direction is represented as a row direction, i.e., a transverse direction of the display region, so the display region of the display panel can be transversely divided into a plurality of segmented regions. For example, the display region can be divided into a plurality of segmented regions equally, or divided into a plurality of segmented regions according to the distribution positions of the uneven display brightness. The number of the segmented regions may depend on a degree of the uneven display brightness of the entire display region or any other factors. For example, when the display brightness is highly uneven, more segmented regions will be divided, and when the display brightness is less uneven, less segmented regions will be divided. In this embodiment, as shown in FIG. 3, the display region of the display panel can be transversely divided into four regions, i.e., I, II, III and IV.

A specific implementation of the division module is also provided in this embodiment, i.e., the division module may divide the pixel units in every m columns into one segmented region, and m is an integer greater than 0. The division module includes a counting unit and a division unit connected to the counting unit. The division unit divides the pixel units in the column corresponding to m×n clock signals into one segmented region every time the m×n clock signals are acquired by the counting unit.

The counting unit may be any counter circuit that widely used for the design of a digital circuit. The counter circuit is a logic circuit capable of outputting a technical signal changed in a certain order according to an input counting pulse signal.

Figure 5:
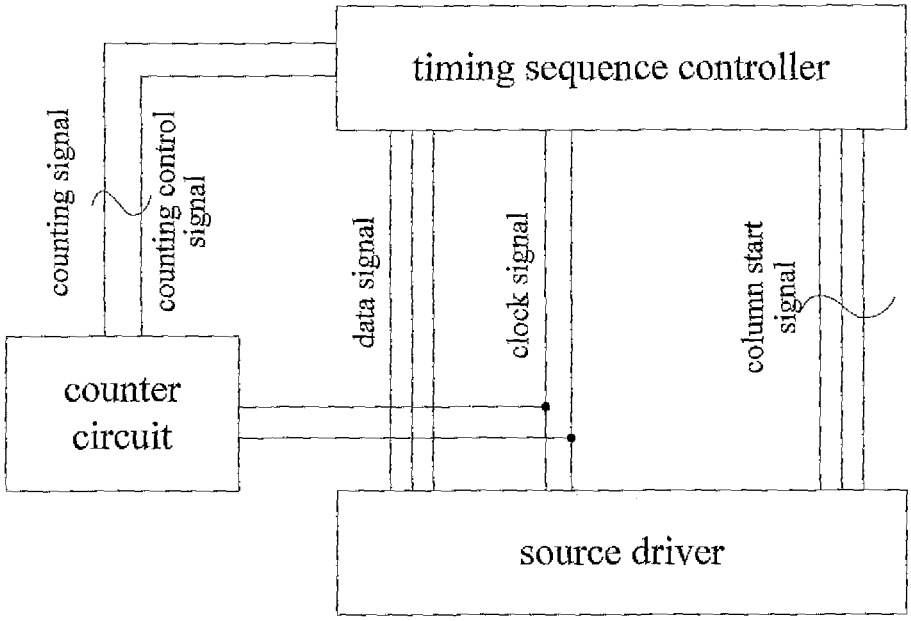
FIG. 5 is a schematic view showing the connection relationship between a counter circuit and a driving system for a display panel according to one embodiment of the present invention.

For example, as shown in FIG. 5, the counter circuit in this embodiment collects the clock signals output from the timing sequence controller to the source driver (since the clock signal is usually a differential signal, so it is required to provide a differential signal receiver at front of a counting pulse signal input port of the counter circuit, so as to convert the received differential signal into the counting pulse signal) utilizes the clock signals output from the timing sequence controller to the source driver as the counting pulse signals, so as to count the pixel units. For example, the counting unit transmits a counting signal to the division unit every time m×n clock signals are acquired by the counter circuit, and the division unit divides the pixel units in the column corresponding to the m×n clock signals into one segmented region.

In this embodiment, the division unit may be integrated into the timing sequence controller. The timing sequence controller outputs a counting control signal to the counter circuit, the counter circuit feeds a counting signal back to the timing sequence controller, the timing sequence controller receives the counting signal so as to determine the segmented region from which the data signal was output. When the counting is started or ended, the timing sequence controller outputs the counting control signal as a counting start signal and a counting end signal to an asynchronous resetting port of the counter circuit. The counter circuit outputs the counting signal to the timing sequence controller, so as to obtain the segmented region to which the currently-outputted data signal belongs. For example, for the counter circuit with an Mode 4 counter circuit as its highest stage, the counting signals outputted therefrom are 00, 01, 10 and 11, and the timing sequence controller can determine the segmented region to which the current data signal belongs according to the received counting signals. For instance, when the received counting signal is 10, the timing sequence controller may determine that the current data signal belongs to the third segmented region.

The counter circuit in this embodiment will be described hereinafter by taking a miniLVDS 6pair 8bit signal transmission mode as an example.

Figure 6:
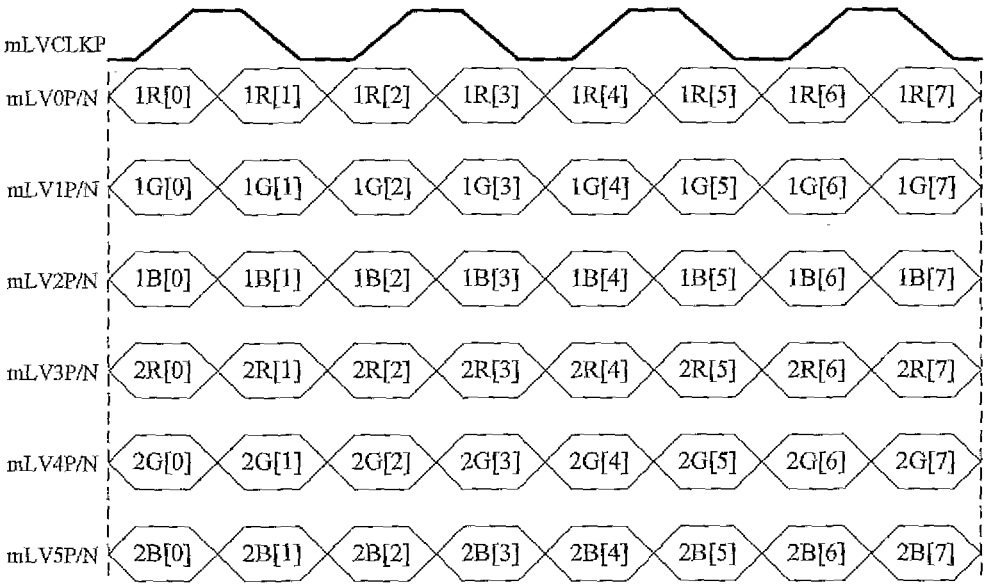
FIG. 6 is a schematic view showing a miniLVDS 6pair 8bit signal transmission format.

As shown in FIG. 6, which is a schematic view showing a miniLVDS 6pair 8bit signal transmission format, every eight clock signals corresponds to two data signals. If a resolution of the display device is 1366×768, there will be 1366 columns of pixels in total. Based on the above, if it is desired to divide the display region into four segmented regions, a first stage of the counter circuit may be designed as an Mode 8 counter, a second stage thereof may be designed as an Mode 171 counter, and a third stage thereof may be design as an Mode 4 (or higher) counter. In this way, the third stage of the counter circuit will feed the counting signal back to the timing sequence controller every time 342 data signals have been transmitted. Of course, the counter circuit may be implemented in various forms. For example, the first stage is designed as an Mode 1368 counter, and the second stage is designed as an Mode 4 counter and feeds back the counting signal to the timing sequence controller. For another example, the first stage is designed as an Mode 8 counter, the second stage is designed as an Mode 9 counter, the third stage is designed as an M29 counter, and the fourth stage is designed as an M5 counter and feeds the counting signal back to the timing sequence controller. However, the counter circuit is not limited to the modes listed herein.

The collection module mainly functions to collect the display brightness of the respective segmented regions. For example, the collection module may be a color analyzer as shown in FIG. 3, or any other device capable of measuring the display brightness. For convenience, in this embodiment, the collection module collects the display brightness at a center of the respective segmented region as the display brightness of the segmented region. Of course, the display brightness of the segmented region may be acquired in any other ways, e.g., the display brightness at a plurality of points within the segmented region may be acquired respectively, and an average value of the display brightness at the plurality of points is calculated as the display brightness of the segmented region.

The comparison module mainly functions to set the reference brightness in the current grayscale according to the collected display brightness. The reference brightness can be set according to various factors, and a commonly used method, for example, is to compare the display brightness of the respective segmented regions, and use the minimum display brightness thereamong as the reference brightness in the current grayscale. During the subsequent adjustment procedure, it is required to reduce other display brightness. For another example, the comparison module may compare the display brightness of the respective segmented regions, and use the maximum display brightness as the reference brightness in the current grayscale. During the subsequent adjustment procedure, it is required to increase other display brightness. Of course, the reference brightness in the current grayscale may be set in any other ways according to the collected display brightness.

The adjustment module mainly functions to adjust the display brightness in the current grayscale of each segmented region according to the reference brightness in the current grayscale and the display brightness of each segmented region, so as to optimize the brightness evenness of the entire display region and improve the uneven display brightness. In this embodiment, the adjustment module includes a determination unit and an adjustment unit connected to the determination unit. With respect to each segmented region, the determination unit determines whether or not a difference between the display brightness of the segmented region and the reference brightness is greater than a predetermined value, and if yes, adjusts the display brightness of the segmented region in the current grayscale according to the difference, so that the display brightness in the current grayscale of the segmented region is closer to the reference brightness. The adjustment unit may be integrated into the timing sequence controller in which compensation voltage data for the respective segmented regions is pre-stored. As shown in FIG. 5, after the counter circuit feeds the counting signal back to the timing sequence controller, the timing sequence controller determines the segmented region to which the currently-outputted data signal belongs according to the counting signal, and then selects the corresponding compensation voltage according to the pre-stored compensation voltage data for the segmented region so as to adjust the display brightness of the segmented region.

Second Embodiment

Figure 7:
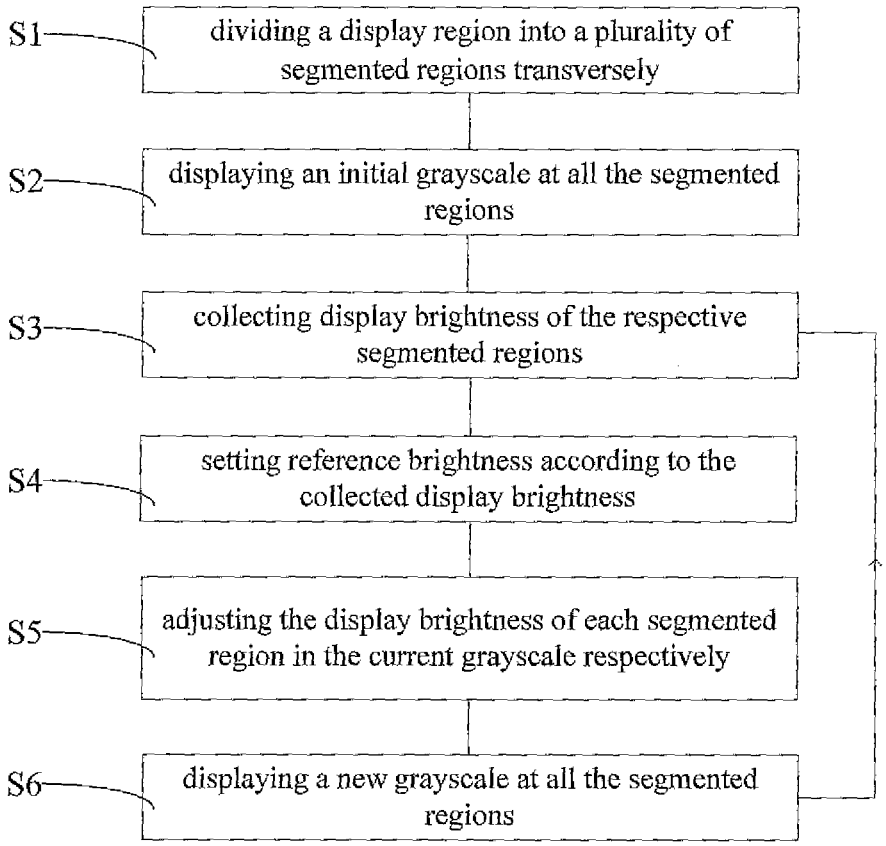
FIG. 7 is a flow chart showing a method for improving uneven display brightness according to the second embodiment of the present invention.

As shown in FIG. 7, a method for improving uneven display brightness is provided in this embodiment, which mainly includes:

Step S1 of dividing a display region into a plurality of segmented regions in a scanning line direction;

Step S2 of displaying an initial grayscale at all the segmented regions;

Step S3 of collecting display brightness of the respective segmented regions;

Step S4 of setting reference brightness according to the collected display brightness of the respective segmented regions;

Step S5 of adjusting the display brightness in the current grayscale of each segmented region respectively according to the reference brightness and the display brightness of each segmented region; and Step S6 of displaying a next grayscale at all the segmented regions, and proceeding to Step S3.

The method may be implemented by the apparatus for improving uneven display brightness mentioned in the first embodiment, or in any other known ways, which are not particularly defined herein. The method will be described hereinafter by taking the improvement on the uneven display brightness for each grayscale of the display device as an example.

As shown in FIG. 7, the method for improving uneven display brightness according to this embodiment includes the following steps.

Step S1: dividing the display region into a plurality of segmented regions in the scanning line direction;

For an existing display device, the scanning line direction is usually represented as a row direction, i.e. a transverse direction of the display region. Therefore, dividing the display region in transverse direction into a plurality of segmented regions in this embodiment is taken as an example. For example, the display region may be divided into a plurality of segmented regions equally, or divided into a plurality of segmented regions according to the distribution positions of the uneven display brightness. The number of the segmented regions may depend on a degree of the uneven display brightness of the entire display region or any other factors. For example, when the display brightness is highly uneven, more segmented regions will be divided, and when the display brightness is less uneven, less segmented regions will be divided. In this embodiment, as shown in FIG. 3, the display region of the display panel may be transversely divided into four regions, i.e., I, II, III and IV. A specific implementation of the above-mentioned division is also provided in this embodiment, i.e., the pixel units in every m columns are divided into one segmented region, and m is an integer greater than 0. To be specific, the pixel units in the column corresponding to m×n clock signals are divided into one segmented region every time the m×n clock signals are acquired.

Step S2: displaying the initial grayscale at all the segmented regions. The initial grayscale may be a grayscale of 255, or of 0. In this embodiment, the grayscale of 255 is taken as an example, i.e., the grayscales at the segmented regions are displayed in a descending order from the grayscale of 255.

Step S3: collecting the display brightness of the respective segmented regions. For example, the display brightness at the center of the respective segmented regions are collected as the display brightness of each segmented region respectively. Of course, the display brightness of the segmented region may be acquired in any other ways. For example, the display brightness at a plurality of points within the segmented region may be acquired, respectively, and then an average value of the display brightness at the plurality of points is calculated as the display brightness of the segmented region.

Step S4: setting the reference brightness according to the collected display brightness of the respective segmented regions. The reference brightness may be set according to various factors, and a commonly used method is to compare the display brightness of the respective segmented regions, and use the minimum display brightness as the reference brightness in the current grayscale. During the subsequent adjustment procedure, it is required to reduce other display brightness. For another example, the display brightness of the respective segmented regions may be compared with each other, and the maximum display brightness may be used as the reference brightness in the current grayscale. During the subsequent adjustment procedure, it is required to increase other display brightness. In the procedure of improving the uneven display brightness in the next grayscale, the brightness of the segmented region with the minimum or maximum display brightness is still used as the reference brightness. Of course, the reference brightness in the current grayscale may be set in any other ways according to the collected display brightness.

Step S5: adjusting the display brightness of each segmented region in the current grayscale respectively according to the reference brightness and the display brightness of each segmented region, so as to optimize the brightness evenness of the entire display region, thereby to improve the uneven display brightness.

Step S6: displaying the next grayscale at all the segmented regions, and proceeding to step S3. That is, displaying grayscales of 254, 253, . . . , 0 sequentially, and repeating Steps S3-S5 in each grayscale. In order to facilitate the differentiation and collection of the display brightness, the improvement may merely be performed every time with respect to the grayscales for the pixels in one color, e.g., the above improving procedure is only performed with respect to red pixel. In this way, the grayscales for the pixels of other colors may be adjusted after all of the grayscales for the pixels in the color that have been adjusted.

Preferably, Step S5 further includes:

with respect to each segmented region, determining whether or not the difference between the display brightness of the segmented region and the reference brightness is greater than the predetermined value, if yes, adjusting the display brightness of the segmented region in the current grayscale according to the difference, so that the display brightness of the segmented region in the current grayscale is closer to the reference brightness, and if not, proceeding to Step S6.

Figure 8:
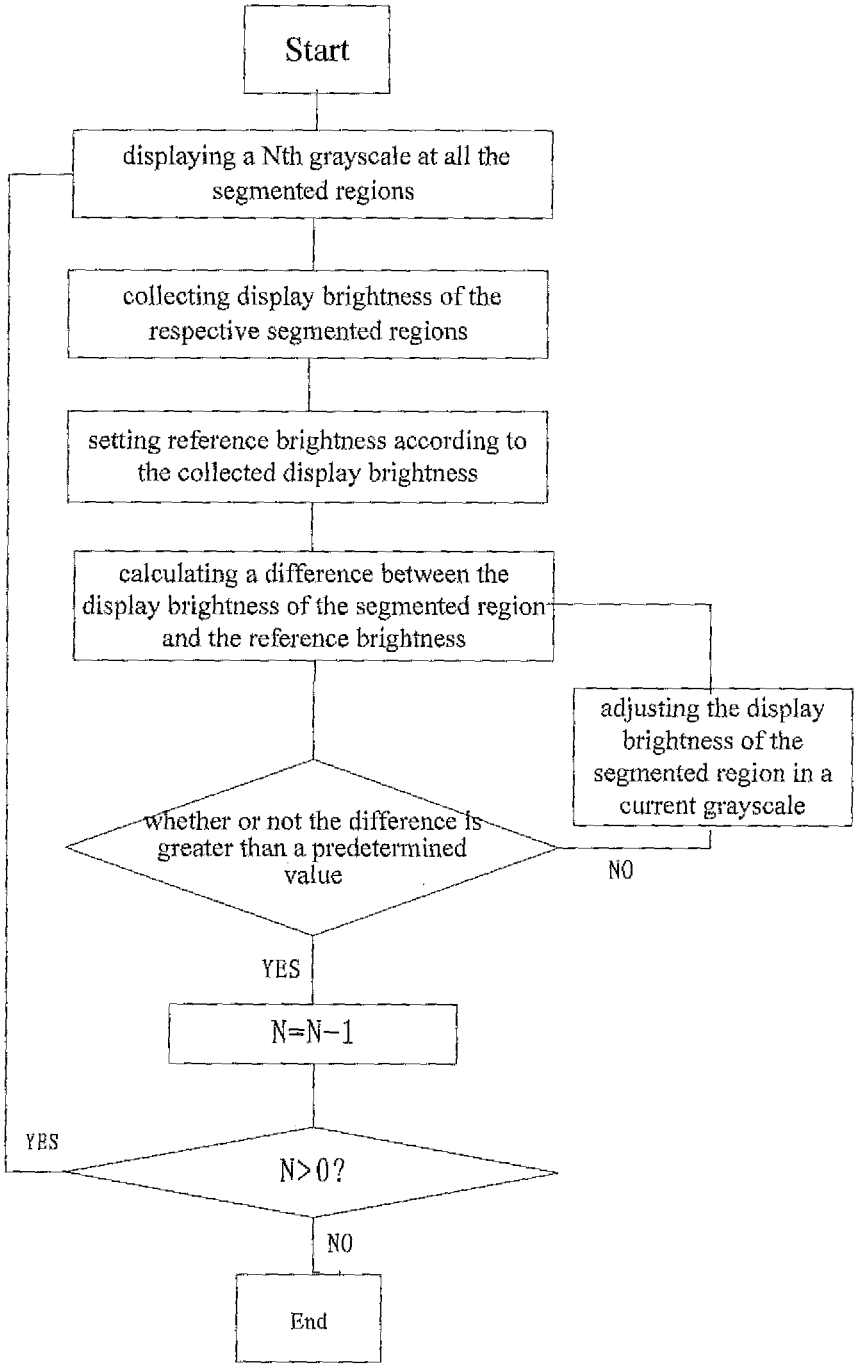
FIG. 8 is a flow chart showing an implementation of the method for improving uneven display brightness illustrated in FIG. 7.

FIG. 8 is a flow chart of an implementation of the method for improving uneven display brightness in FIG. 7.

The above are merely the preferred embodiments of the present invention. It should be appreciated that, a person skilled in the art may make further improvements and modifications without departing from the principle of the present invention, and these improvements and modifications shall also fall within the scope of the present invention.

What is claimed is:

1. An apparatus for improving uneven display brightness, comprising:

a division circuit configured to divide a display region into a plurality of segmented regions in a scanning line extension direction;

a collection circuit configured to collect display brightness of the respective segmented regions;

a comparison circuit configured to set reference brightness in a current grayscale according to the collected display brightness of the respective segmented regions; and an adjustment circuit configured to adjust the display brightness of each segmented region in the current grayscale respectively according to the reference brightness in the current grayscale and the display brightness of each segmented region, wherein the display region is provided with a plurality of pixel units arranged in a matrix form, the division circuit transversely divides the pixel units in every m columns into one segmented region in the scanning line extension direction, with m being an integer greater than 0.

2. The apparatus according to claim 1, wherein the pixel units in each column are connected to a data line which is connected to a source driver, and the source driver is configured to output one data signal to the data lines according to $n$ clock signals output from a timing sequence controller, the division circuit comprises a counting unit and a division unit connected to the counting unit, and the division unit divides the pixel units in the column corresponding to $m \times n$ clock signals into one segmented region every time the $m \times n$ clock signals are acquired by the counting unit.

3. The apparatus according to claim 2, wherein the counting unit comprises a counter circuit configured to collect the clock signal output from the timing sequence controller to the source driver and use the clock signal as a counting pulse signal so as to count the pixel units.

4. The apparatus according to claim 3, wherein the division unit is integrated into the timing sequence controller.

5. The apparatus according to claim 1, wherein the collection circuit collects the display brightness at a center of each segmented region as the display brightness of the segmented region respectively.

6. The apparatus according to claim 1, wherein the collection circuit collects the display brightness at a plurality of points within each segmented region and calculates an average value of the display brightness at the plurality of points as the display brightness of the segmented region respectively.

7. The apparatus according to claim 1, wherein the comparison circuit compares the display brightness of the respective segmented regions and uses the minimum display brightness as the reference brightness in the current grayscale.

8. The apparatus according to claim 7, wherein the adjustment circuit comprises a determination unit and an adjustment unit connected to the determination unit, and with respect to each segmented region, when the determination unit determines that a difference between the display brightness of the segmented region and the reference brightness is greater than a predetermined value, the adjustment unit adjusts the display brightness of the segmented region in the current grayscale according to the difference.

9. The apparatus according to claim 8, wherein the adjustment unit is integrated into the timing sequence controller.

10. A display device comprising the apparatus for improving uneven display brightness according to claim 1.

11. A method for improving uneven display brightness, comprising:

Step S1: dividing a display region into a plurality of segmented regions in a scanning line extension direction;

Step S2: displaying an identical, initial grayscale at all the segmented regions;

Step S3: collecting display brightness of the respective segmented regions;

Step S4: setting reference brightness according to the collected display brightness of the respective segmented regions;

Step S5: adjusting the display brightness in the current grayscale of each segmented region respectively according to the reference brightness and the display brightness of each segmented region, so as to reduce the difference in the display brightness in the current grayscale among the respective segmented regions; and Step S6: displaying a next grayscale at all the segmented regions, and proceeding to Step S3, wherein the display region is provided with pixel units arranged in a matrix form, the pixel units in every m columns are transversely divided into one segmented region in the scanning line extension direction, and m is an integer greater than 0.

12. The method according to claim 11, wherein the initial grayscale is a grayscale of 255, and the next grayscale is a grayscale obtained by reducing the current grayscale by one grayscale.

13. The method according to claim 11, wherein the pixel units in each column are connected to a data line which is connected to a source driver, and the source driver is configured to output one data signal to the data line according to n clock signals output from a timing sequence controller, and the pixel units in the column corresponding to m×n clock signals are divided into one segmented region every time the m×n clock signals are output.

14. The method according to claim 11, wherein Step S3 further comprises:

collecting the display brightness at a center of the respective segmented regions as the display brightness of the segmented region.

15. The method according to claim 11, wherein Step S3 further comprises:

collecting the display brightness at a plurality of points within the respective segmented regions and calculating an average value of the display brightness at the plurality of points as the display brightness of the segmented region.

16. The method according to claim 11, wherein Step S4 further comprises:

comparing the display brightness of the respective segmented regions and using the minimum display brightness as the reference brightness in the current grayscale.

17. The method according to claim 13, wherein Step S4 further comprises:

comparing the display brightness of the respective segmented regions and using the minimum display brightness as the reference brightness in the current grayscale.

18. The method according to claim 16, wherein Step S5 further comprises:

with respect to each segmented region, determining whether or not a difference between the display brightness of the segmented region and the reference brightness is greater than a predetermined value, if yes, adjusting the display brightness in the current grayscale of the segmented region, and if not, proceeding to Step S6.

* * * * *